US007506483B2

(12) United States Patent
Thoeny

(10) Patent No.: US 7,506,483 B2
(45) Date of Patent: Mar. 24, 2009

(54) INFLATABLE STRUCTURES

(76) Inventor: Theodore T. Thoeny, 2981 Hollister Rd., San Juan, Bautista, CA (US) 95045

( * ) Notice: Subject to any disclaimer, the term of this patent is extended or adjusted under 35 U.S.C. 154(b) by 445 days.

(21) Appl. No.: 11/250,278

(22) Filed: Oct. 14, 2005

(65) Prior Publication Data

US 2007/0094938 A1 May 3, 2007

(51) Int. Cl.
*E04B 1/00* (2006.01)

(52) U.S. Cl. ..... 52/745.15; 52/2.11; 52/2.22

(58) Field of Classification Search ..... 52/2.11, 52/2.15, 741.15, 745.06, 745.05, 745.07, 52/3, 2.22; 264/45.2; 434/81, 82
See application file for complete search history.

(56) References Cited

U.S. PATENT DOCUMENTS

| | | | | | |
|---|---|---|---|---|---|
| 2,689,812 | A | * | 9/1954 | Mollica et al. | 156/281 |
| 2,743,510 | A | * | 5/1956 | Mauney et al. | 428/12 |
| 2,812,769 | A | * | 11/1957 | Schaefer et al. | 52/2.15 |
| 3,118,010 | A | * | 1/1964 | Harrington | 264/32 |
| 3,225,413 | A | * | 12/1965 | Bird et al. | 425/438 |
| 3,232,806 | A | * | 2/1966 | Widmer | 156/212 |
| 3,506,746 | A | | 4/1970 | Fontaine | 264/32 |
| 3,668,287 | A | * | 6/1972 | Mackie | 264/45.2 |
| 3,779,847 | A | | 12/1973 | Turner | 156/156 |
| 3,801,685 | A | | 4/1974 | Bell, Jr. | 264/45 |
| 4,041,671 | A | * | 8/1977 | Nicholson | 52/745.07 |
| 4,064,663 | A | * | 12/1977 | Moss | 52/81.1 |
| 4,170,093 | A | * | 10/1979 | Cappellini et al. | 52/745.07 |
| 4,365,455 | A | | 12/1982 | Braine | 52/741 |
| 4,442,059 | A | | 4/1984 | Boyce | 264/228 |
| 4,550,544 | A | | 11/1985 | Thoeny | 52/741 |
| 4,651,478 | A | | 3/1987 | Dahl et al. | 52/2 |
| 4,683,696 | A | * | 8/1987 | Thoeny | 52/247 |
| 4,746,471 | A | | 5/1988 | Hale | 264/32 |
| 4,799,982 | A | | 1/1989 | Vicino | 156/71 |
| 5,522,181 | A | * | 6/1996 | Ellsworth | 52/2.15 |
| 5,570,544 | A | * | 11/1996 | Hale et al. | 52/2.18 |
| 5,579,609 | A | * | 12/1996 | Sallee | 52/2.11 |
| 5,675,941 | A | * | 10/1997 | Dykmans | 52/81.6 |
| 5,761,852 | A | * | 6/1998 | Liu | 52/2.18 |

* cited by examiner

*Primary Examiner*—Richard E Chilcot, Jr.
*Assistant Examiner*—Anthony N Bartosik

(57) ABSTRACT

A method of forming a building structure in a desired contoured configuration. An inner supporting fabric is inflated into at least one form. An outer finishing fabric is draped over the inflated form. A coating is applied to the outer finishing fabric and a hardened shell is formed. The inner supporting fabric may be removed.

4 Claims, 6 Drawing Sheets

INFLATABLE STRUCTURES

BACKGROUND OF THE INVENTION

The present invention relates to a method for forming structures and more specifically to a method of constructing a structure having a desired contoured configuration.

Inflatable forms for construction of structures have been known for many years. The inventor is aware of the following U.S. patents (two of which are his).

| Inventor(s) | U.S. Pat. No. |
|---|---|
| Bird et al | 3,225,413 |
| Widmer | 3,232,806 |
| Fontaine | 3,506,746 |
| Turner | 3,779,847 |
| Bell, Jr. | 3,801,685 |
| Nicholson | 4,041,671 |
| Braine | 4,365,455 |
| Boyce | 4,442,059 |
| Thoeny | 4,550,544 |
| Dahl et al | 4,651,478 |
| Thoeny | 4,683,696 |
| Hale | 4,746,471 |
| Vicino | 4,799,982 |
| Sallee | 5,579,609 |

The problem with these references is the limitation of the shape of the structure formed in space using fabric. Present technology of forming fabric (non-woven, woven, knitted, etc.) permits the production of very large expanses of fabric which can be disposed over a skeletal structure to form a structure having a desired contoured configuration. Further, the prior art required considerable labor, time and materials. There is a need for a method of forming a structure having a desired contoured configuration at reduced costs and time, as well as obtaining unusual and artistic contours and configurations in the finished product.

OBJECT AND SUMMARY OF THE INVENTION

It is a primary object of the invention to provide a method of forming a structure having a desired contoured configuration, which is economical and easily constructed, as well as unusual and architecturally pleasing.

In accordance with the teachings of the present invention, there is disclosed a method of erecting a building structure including a roof and side walls having a desired contoured configuration to provide a visually appealing esthetic effect. A first inner supporting fabric is provided. The first inner supporting fabric is inflated forming at least one domed structure. A second outer finishing fabric is draped over the at least one domed structure. The second outer finishing fabric is supported substantially throughout by the inflated first inner supporting fabric and the second outer finishing fabric assumes the desired contoured configuration. The surface of the second outer finishing fabric is coated with a stiffener to thereby assure the rigidity of the desired contoured configuration in the building structure. The stiffener is allowed to cure. The first inner supporting fabric is deflated.

These and other objects of the present invention will become apparent from a reading of the following specification taken in conjunction with the enclosed drawings.

DESCRIPTION OF THE PREFERRED EMBODIMENT

Figure 1:
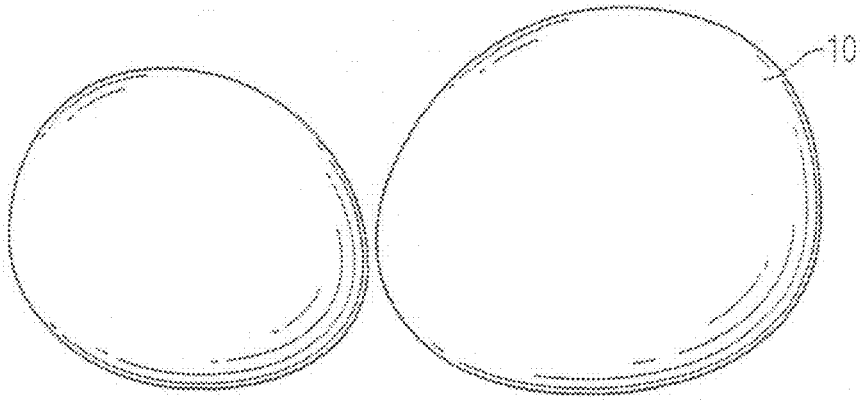
FIG. 1 is a perspective view of inflated forms.

Referring to FIG. 1, an inflated form 10 or plurality of forms are prepared to provide a desired configuration of the structure. Although two inflated forms are shown in FIG. 1, the invention is not limited by the number or size of inflated forms nor is the positioning of the forms with respect to one another. The forms may be linearly aligned, in a circular arrangement, a polygonal configuration or randomly placed. The forms may be abutted or spaced apart from one another.

Figure 2:
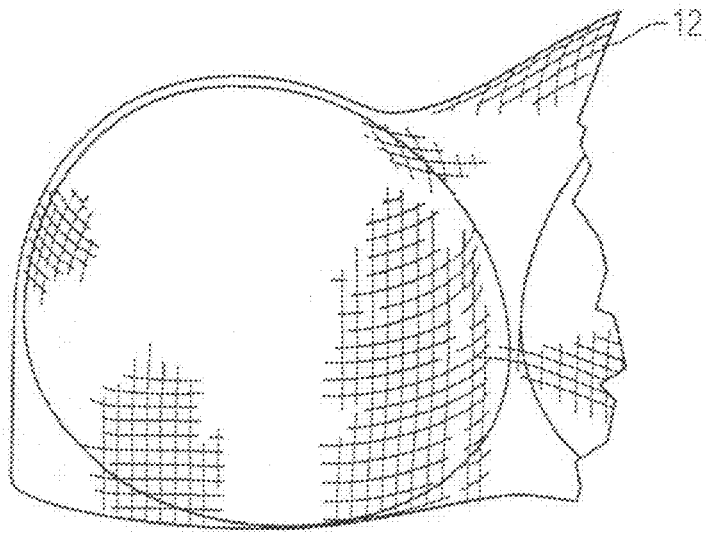
FIG. 2 is an enlarged view of fabric draped over a portion of the inflated forms.
Figure 3:
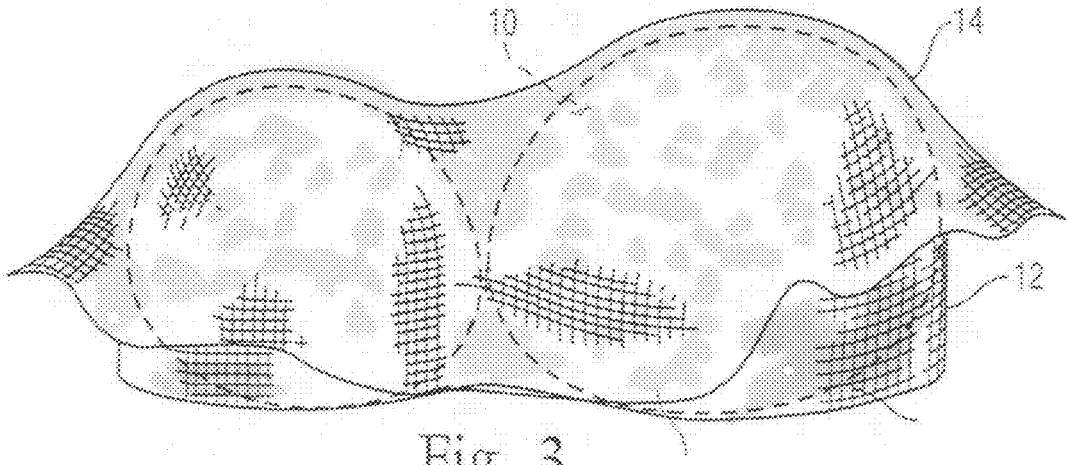
FIG. 3 is a perspective view of the outer fabric being disposed over the covered inflated forms.

Although not necessary, the inflated form may have an internal skeletal structure such as supports or framing over which a first inner supporting fabric 12 is draped. A structure having an area greater than one acre or a structure the size of a house can be made. Compressed air, gas under pressure or pressurized air introduced by fans or heated air is introduced into the first inner supporting fabric 12 to inflate the fabric forming at least one domed structure. A second outer finishing fabric 14 is draped over the first inner supporting fabric 12 in its inflated condition (FIG. 2). The second outer finishing fabric 14 assumes the desired configuration based on the disposition of the inflated forms 10 (FIG. 3). The second outer finishing fabric 14 is supported substantially throughout by the inflated first inner supporting fabric 12 which may act as a release or separation between the first inner supporting fabric 12 and the second outer finishing fabric 14.

Figure 4:
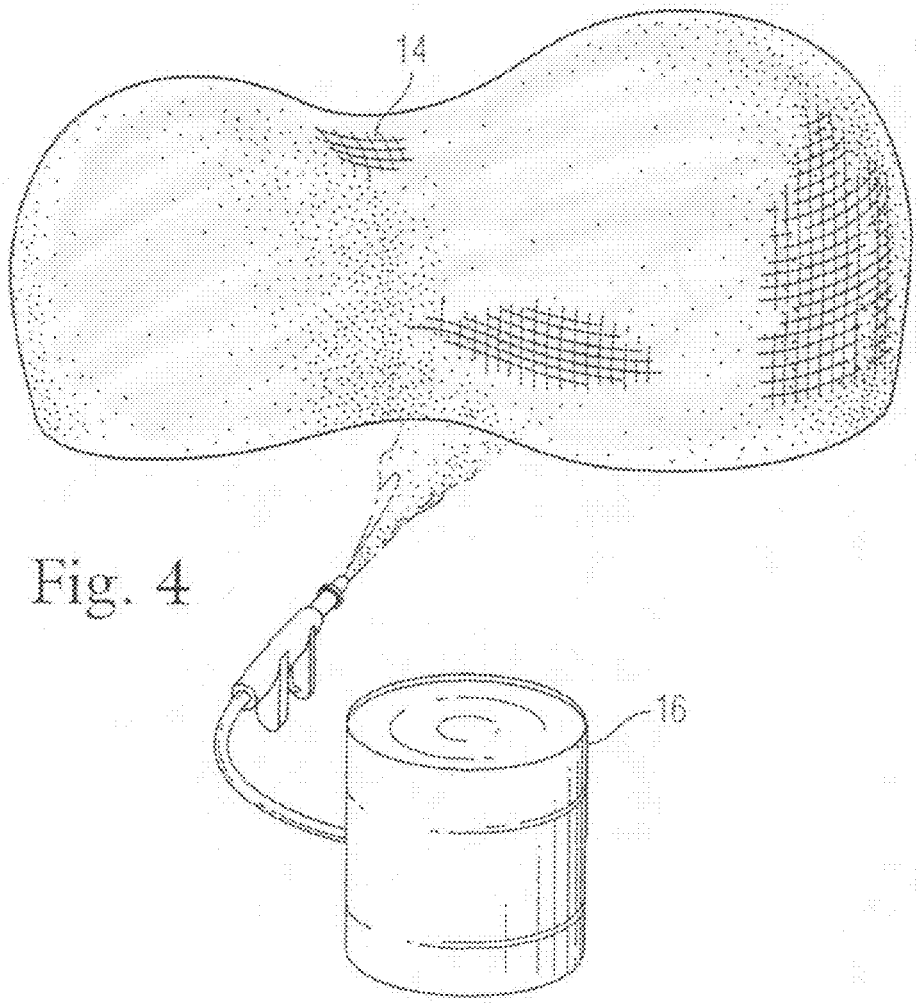
FIG. 4 is a perspective view of the covered inflated form being sprayed.
Figure 5:
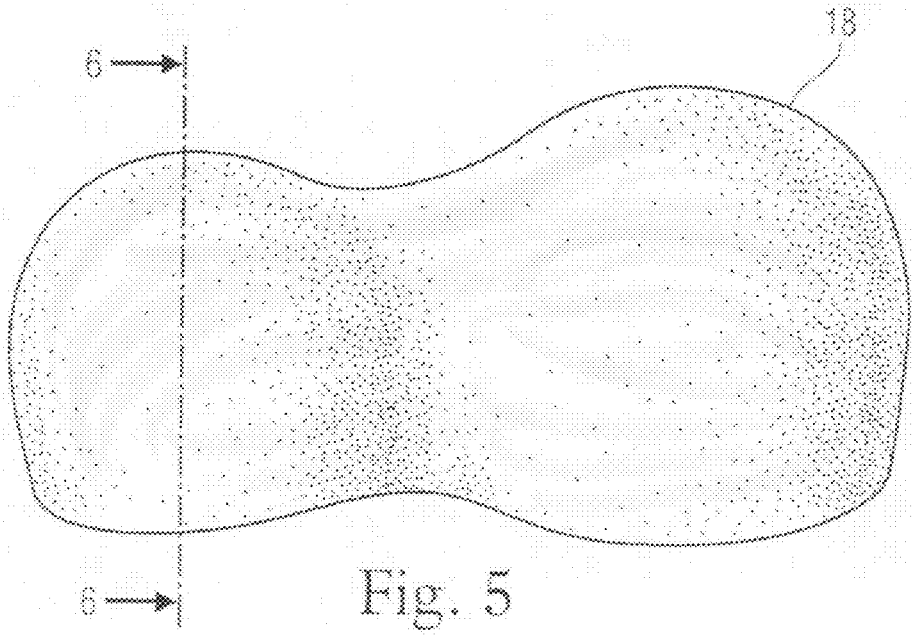
FIG. 5 is a perspective view of the hardened shell.
Figure 6:
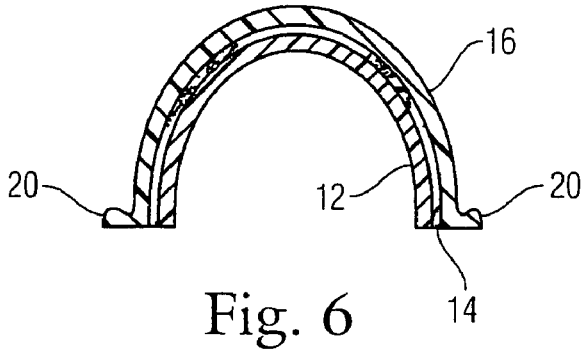
FIG. 6 is a cross-sectional view taken across lines 6-6 of FIG. 5.

As shown in FIG. 4 the second outer finishing fabric 14 is sprayed or coated with a hardener or stiffener 16. The hardener or stiffener may be a plastic, cement or other desired material which assumes the shape and configuration of the surface of the outer finishing fabric. The hardener or stiffener sets up or cures to form a rigid hardened shell 18 (FIGS. 5-6). Additional coatings may be applied to the initial coating.

After the hardened shell 18 has been formed, and if desired, the inner form may be deflated and the inner supporting fabric may be removed, leaving the rigid structure in the desired configuration.

Figure 7:
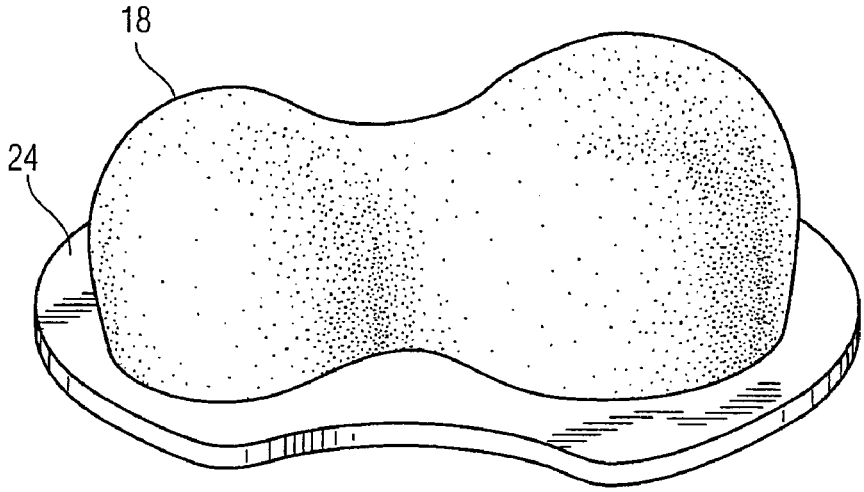
FIG. 7 is a perspective view of the shell having a stiffened edge member.
Figure 8:
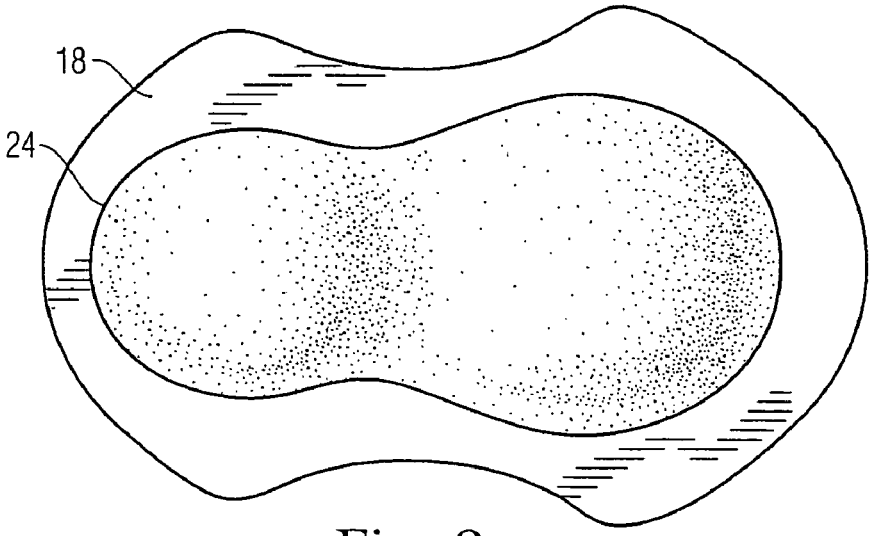
FIG. 8 is a top plan view of the structure having a stiffened edge member.
Figure 9:
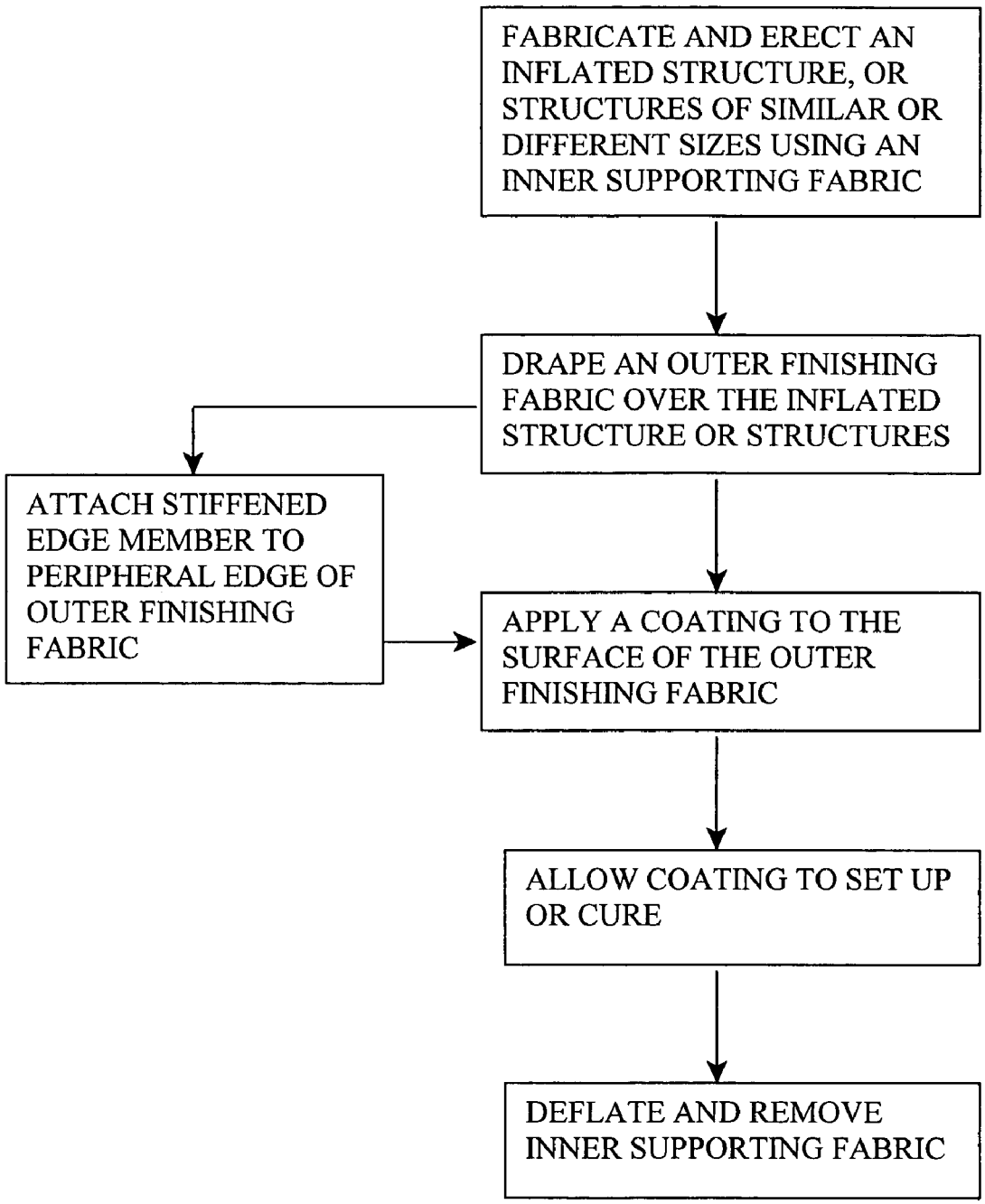
FIG. 9 is a diagram showing the method of forming the structure of the present invention.
Figure 10:
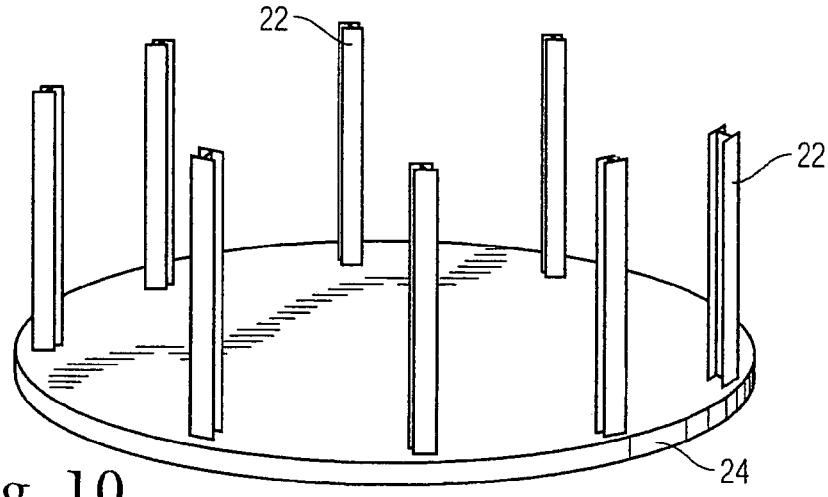
FIG. 10 is a perspective view showing vertical supports disposed on a foundation.
Figure 11:
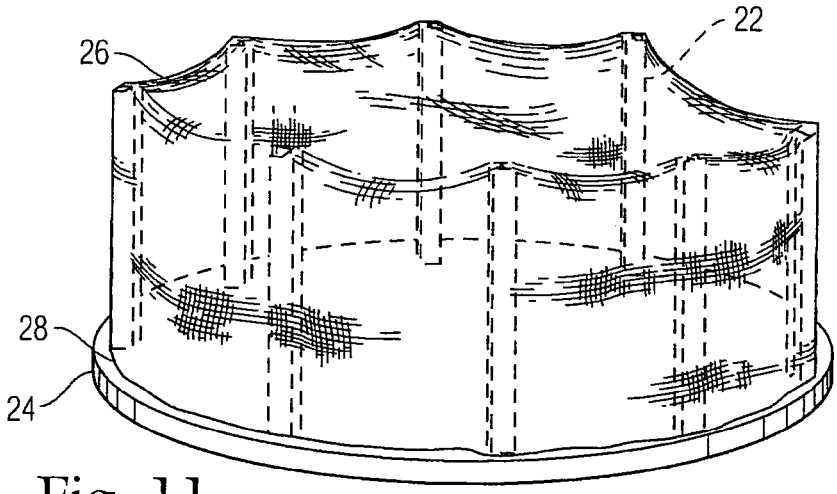
FIG. 11 is a perspective view showing a first member draped over the supports.
Figure 12:
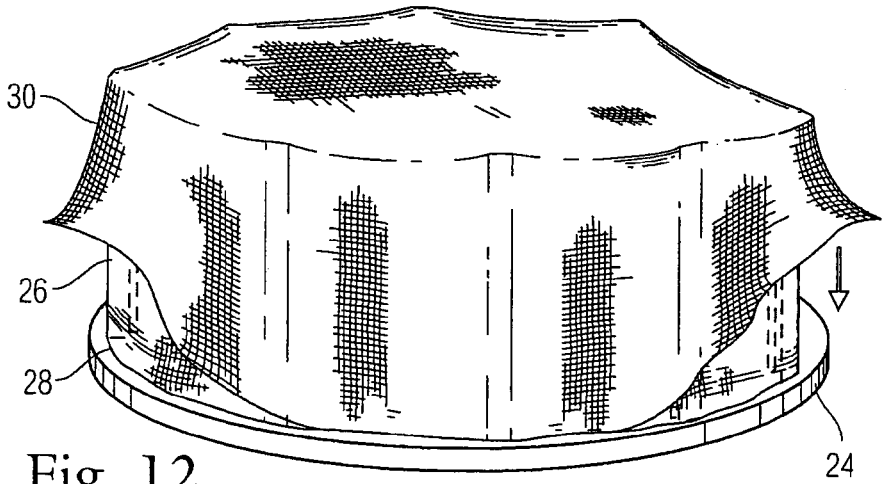
FIG. 12 is a perspective view showing a second member draped over the first member.
Figure 13:
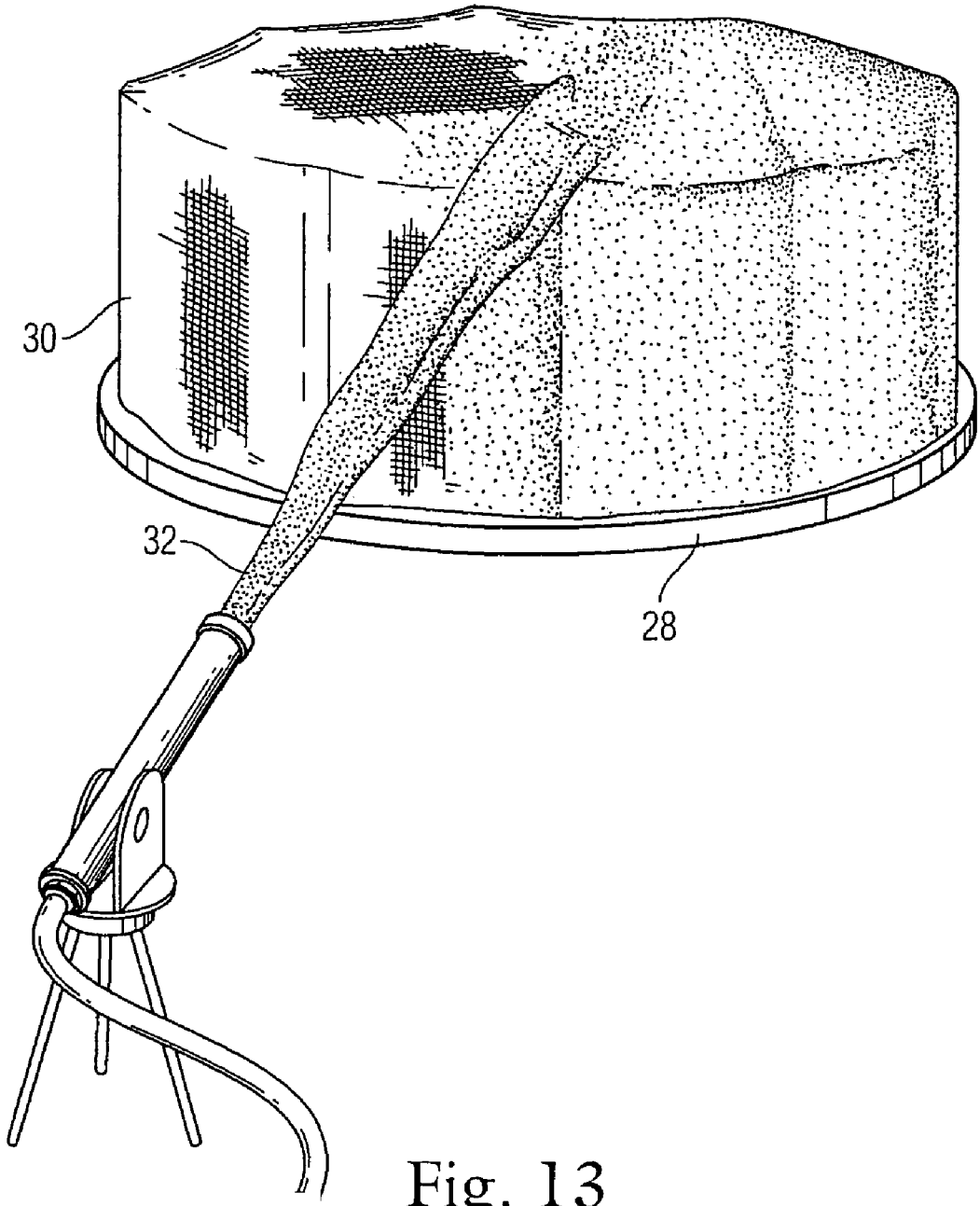
FIG. 13 is a perspective view showing an exterior coating applied to the second member.

A stiffened edge member 20 may be attached to or formed on the peripheral edge of the outer finishing fabric 14 to better define the configuration of the shell 18. If desired, the edge member can be vertically or horizontally undulating, straight or of any desired shape (FIGS. 7 and 8). The stiffened edge member may be at ground level or may be elevated at various locations along the perimeter.

Alternately, (FIGS. 10-13) the structures may be formed using draped fabric over supports 22 of varying or equal heights which are not inflated. A foundation 24 is formed and vertical supports 22 are disposed peripherally around the foundation that may meander in configuration. A first flexible unshaped member 26 which has a center portion and a peripheral portion 28 is draped over the vertical supports 22 such that the center portion is disposed within the plurality of vertical supports. The peripheral portion 28 is disposed about the periphery of the foundation 24. The peripheral portion 28 may be attached to the foundation 24 if desired. The first unshaped member 26 has now acquired a generalized contoured configuration as determined by the supports in the foundation. A second sheet 30 of porous or substantially non-porous material is draped over the first member acquiring a desired contoured configuration. An exterior coating 32 is applied to the second sheet 30 of material. The exterior coating such as plastic or cement sets up and hardens to form a rigid surface having a desired configuration. The vertical supports are removed.

The draped fabric can also be sprayed from inside by relocating the inflatable forms.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. The method of erecting a building structure including a roof and side walls having a desired contoured configuration to provide an esthetic effect comprising the steps of:

providing a first inner supporting fabric, inflating the first inner supporting fabric forming a first domed structure, providing at least a second inner supporting fabric, inflating the at least a second inner supporting fabric forming at least a second domed structure spaced apart from the first domed structure, draping an outer finishing fabric over the first domed structure and over the at least a second domed structure wherein the outer finishing fabric is supported substantially throughout by the inflated first inner supporting fabric and the inflated second inner supporting fabric and the outer finishing fabric assumes the desired contoured configuration, forming a unitary covering over all of the domed structures, coating a surface of the outer finishing fabric with a stiffener thereby assuring rigidity of the desired contoured configuration in the building structure, allowing the stiffener to cure, and deflating the first inner supporting fabric and the at least a second inner supporting fabric thereby forming a single layered structure having the desired contoured configuration.

2. The method of claim 1, further comprising the steps of removing the first inner supporting fabric and the at least second inner supporting fabric from the building structure.

3. The method of claim 1, further attaching a stiffened edge member on the outer finishing fabric, the stiffened edge member having a desired configuration.

4. An intermediary building structure including a roof and side walls having a desired contoured configuration to provide an esthetic effect comprising:

an inflated first inner supporting fabric, and a spaced-apart inflated second inner supporting fabric, an outer finishing fabric including a hardening coating draped over the inflated first inner supporting fabric and over the inflated second inner supporting fabric and arranged to obtain a unitary covering over the inflated first inner supporting fabric and over the spaced-apart inflated second inner supporting fabric in a desired configuration to achieve an architecturally pleasing esthetic effect.

* * * * *